US006233847B1

(12) United States Patent
Brown

(10) Patent No.: US 6,233,847 B1
(45) Date of Patent: May 22, 2001

(54) CONTOURED INSOLE FOR FOOTWEAR

(75) Inventor: Dennis N. Brown, Blaine, WA (US)

(73) Assignee: Superfeet Worldwide LLC, Ferndale, WA (US)

( * ) Notice: Subject to any disclaimer, the term of this patent is extended or adjusted under 35 U.S.C. 154(b) by 0 days.

(21) Appl. No.: 09/586,654

(22) Filed: Jun. 1, 2000

Related U.S. Application Data

(62) Division of application No. 09/192,830, filed on Nov. 16, 1998, now Pat. No. 6,070,342.

(51) Int. Cl.[7] ..... A43B 13/41
(52) U.S. Cl. ..... 36/44; 36/174; 36/180
(58) Field of Search ..... 36/44, 43, 174–178, 36/180, 182

(56) References Cited

U.S. PATENT DOCUMENTS 4,586,273 * 5/1986 Chapnick .
4,597,196 * 7/1986 Brown .
4,962,593 * 10/1990 Brown .
5,174,052 * 12/1992 Schoenhaus et al. .
6,070,342 * 6/2000 Brown .

FOREIGN PATENT DOCUMENTS

57330 * 1/1953 (FR) .
1079578 * 12/1954 (FR) .
465940 * 5/1937 (GB) .

* cited by examiner

*Primary Examiner*—Ted Kavanaugh
(74) *Attorney, Agent, or Firm*—Todd N. Hathaway

(57) ABSTRACT

An insole assembly for a shoe or other article of footwear. The assembly includes a soft, cushioning foam blank having an upper surface which is contoured to engage the plantar surface of a foot, and a thin, substantially rigid, resiliently flexible cap which is mounted to the bottom of the blank so as to extend around the heel end and forwardly along the medial and lateral sides thereof. The rigid cap includes an upstanding wall which engages and buttresses the perimeter of the foam blank, and a series of medial and lateral flanges which extend across and support the bottom of the blank. The flanges are configured to cooperate with the foam blank to define zones of support in specific areas, with the maximum support and rigidity being provided for the rearfoot and midfoot areas of the foot.

33 Claims, 3 Drawing Sheets

CONTOURED INSOLE FOR FOOTWEAR

This application is a divisional of application number 09/192,830 filed on Nov. 16, 1998 now U.S. Pat. No. 6,070,342.

BACKGROUND OF THE INVENTION a. Field of the Invention

The present invention relates generally to insoles for footwear, and, more particularly, to a contoured insole having a soft cushioning upper blank and a rigid reinforcement cap which extends around the heel end of the blank so as to provide support at predetermined areas of the insole.

b. Background Art

Cushioning insoles of various types are known for use in shoes, particularly for use in running shoes and other shoes intended for athletic activities. Typically, these insoles take the form of a relatively thin layer of foam material which rests atop the sole of the shoe, and are often removable for washing or replacement.

While commonly used, conventional insoles of this general type have proven less than ideal in several respects. Firstly, the top surface of the foam material is often given a pronounced contour in an effort to support and cradle the wearer's foot, but because the foam is intended mainly to cushion the foot, it typically lacks sufficient strength and firmness to simultaneously provide the necessary support for proper biomechanical function of the foot, particularly in the rearfoot and arch areas. This problem is aggravated by the fact that most athletic shoes are "soft sided" to a greater or lesser extent, i.e., the uppers are formed of cloth, vinyl, or other flexible materials which yield outwardly under pressure, thereby providing very little inward buttressing around the insole. As a result, conventional contoured insoles tend to deform and "mush" downwardly and outwardly under the foot without providing any meaningful level of support, and also tend to break down and lose their shape very rapidly in use.

Some efforts have been made to correct these problems by including higher durometer materials in one or more areas of the device. For example some cushioning insoles have been constructed with a band of heavier durometer rubber or similar material added in the arch area and around the heel of the foam footbed. However, these materials has done little if anything to increase the strength or durability of the insoles, and they have not had the strength or configuration necessary to provide proper support for the wearer's foot.

One form of device which does offer a high degree of durability and support is that which is disclosed in U.S. Pat. No. 4,597,196. This device includes a full-length resilient blank formed of rubber or similar material, with a resilient pad extending longitudinally down the bottom of the blank and a somewhat horseshoe-shaped moldable cork member extending along the sides and around the heel area. The assembly also includes a fairly rigid plastic cap which fits over the bottom of the device and extends partway up the rearfoot sides. However, while highly successful for its intended purposes, this device is principally a custom-molded, multi-component unit, and is consequently comparatively expensive and specialized in nature. Moreover, it is a fairly heavy device, and the added weight may not be desirable in many circumstances, particularly for use in certain athletic shoes.

In short, the construction which is shown in the '196 patent provides a somewhat "high end", specialized product, which is not particularly well suited to the low cost, high volume athletic shoe market.

Accordingly, there exists a need for a lightweight, low-cost contoured insole which provides effective cushioning for a foot, yet which is nevertheless durable and longlasting in use. Furthermore, there exists a need for such an insole which provides proper support in the heel and rearfoot areas so as to optimize the biomechanical motions of the foot.

SUMMARY OF THE INVENTION

The present invention has solved the problems cited above, and is an insole assembly for a shoe or other article of footwear. Broadly, the insole comprises: (a) a substantially soft, resiliently compressible cushioning blank member having an upper surface for engaging a plantar surface of a foot and a bottom surface for engaging a sole of a shoe; and (b) a substantially rigid, resiliently flexible cap member mounted to the blank member, the cap member comprising: an upstanding wall portion which extends in supporting engagement with an outer surface of the blank member around a rearfoot end and along medial and lateral sides thereof, and at least one generally horizontal flange portion which extends inwardly from the wall portion of the cap member in supporting engagement with a bottom surface of the blank member so as to provide additional rigidity and support to the blank member beneath a selected area of the wearer's foot.

The cushioning blank member may comprise a downwardly concave heel cup portion for engaging a heel of the wearer's foot, and an upwardly arched midfoot portion for engaging an arch portion of the foot. The flange portion of the cap member may comprise first and second primary flanges which extend inwardly across the bottom surface of the blank member under the arched midfoot portion thereof, the flanges having inner edges which are spaced apart from one another by a portion of the bottom surface of the blank member. The inner edges of the flanges may follow generally arcuate paths between forward and rearward end points which are located proximate the wall portion of the cap member.

The rearward end points of the flanges may be positioned proximate a forward end of the heel cup portion of the blank member. The flange portion of the cap member may further comprise a horseshoe-shaped rearfoot flange which extends around the rearfoot end of the blank member so as to connect the rearward end points of the primary flanges.

The flange portion of the cap member may further comprise first and second secondary flanges positioned forwardly of the primary flanges. The secondary flanges may have inner edges which are spaced apart from one another by a portion of the open area of the blank member which is wider than that by which the edges of the primary flanges are spaced apart. The inner edges of the secondary flanges may also follow generally arcuate paths between rearward and forward end points which are located proximate the wall portion of the cap member, and the rearward end points of the secondary flanges may coincide with the forward end points of the primary flanges.

The forward end points of the flanges on the medial side of the blank member may be positioned longitudinally forward of the corresponding end points on the lateral side, so that the forward end points define a series of borders of between distinct areas of support between the flanges, which borders extend at rearward angles from the medial side to the lateral side of the blank member. The angles at which the borders extend may be generally parallel to an angle at which the metatarsal heads of a wearer's foot extend, from a medial side to a lateral side thereof.

The present invention also provides a shoe or other article of footwear having an insole assembly generally as described above.

The invention, together with further aspects and advantages thereof, will be further understood by reference to the following detailed description and accompanying drawings.

DETAILED DESCRIPTION

Figure 1:
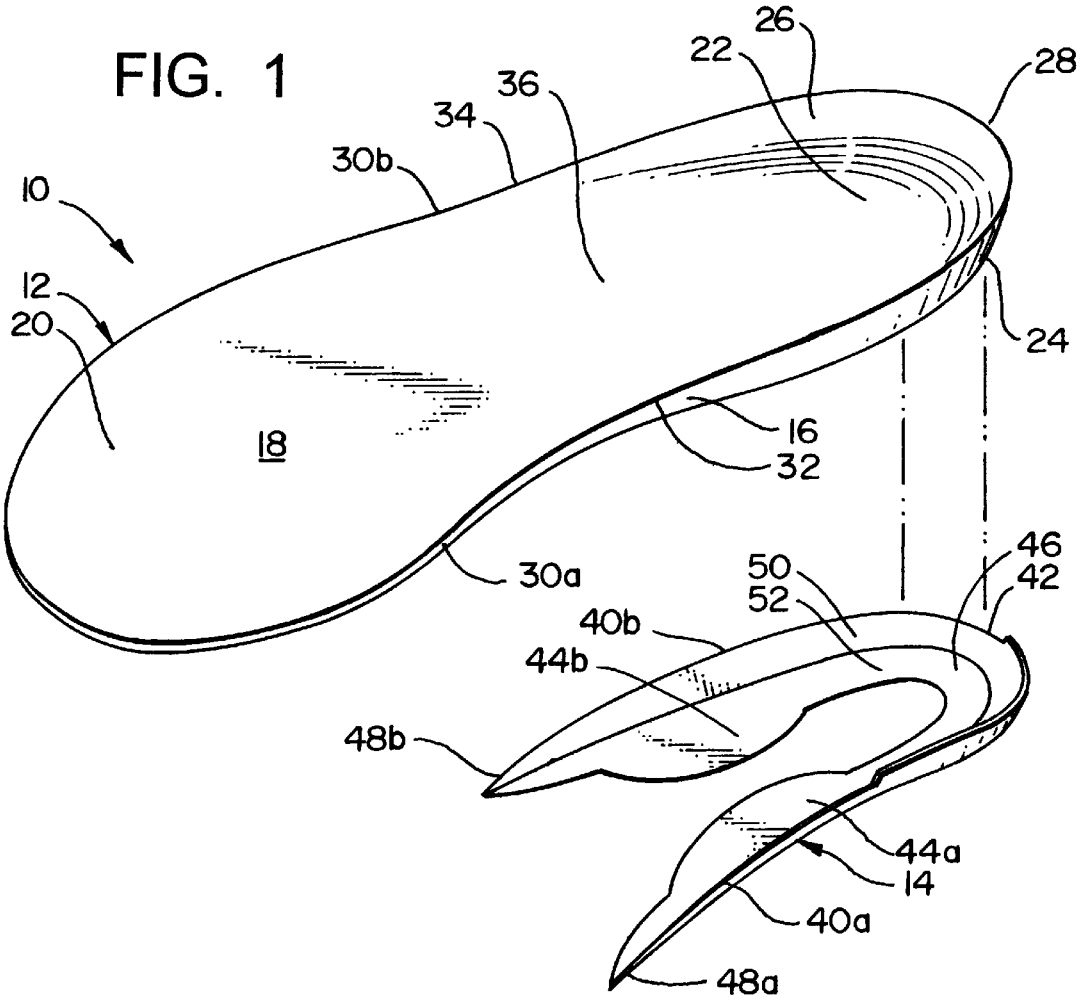
FIG. 1 is a perspective, exploded view of a cushioning insole in accordance with the present invention, showing the cushioning foam blank member and the semi-rigid plastic cap member which is mounted to the bottom surface of the blank member.

FIG. 1 shows a cushioning insole assembly 10 in accordance with the present invention (the insole assembly shown in FIGS. 1–6 is for a right-foot shoe, and it will be understood that the left-foot assembly is substantially mirror-image identical thereto).

As will be described in greater detail below, the orthotic assembly includes both soft and rigid components, which cooperate to maintain the contoured shape of the device without relying on inward buttressing from the shoe upper. As a result, the assembly is durable and particularly adapted to use in athletic shoes, and the contour and shape is maintained without having to compromise the cushioning which is afforded by the device. Furthermore, the components are configured to provide varying degrees of rigidity/support in those areas where it is needed for proper biomechanical operation of the foot, and to provide graduated transitions between these areas which correspond to changes in downward pressure under the foot as it progresses through the gait cycle. Still further, the device achieves these functions with an essentially two-component assembly, which is both light in weight and inexpensive to manufacture.

a. Structure

As can be seen in FIG. 1, the principal components which make up the insole assembly 10 are an upper, cushioning blank member 12, and a lower, generally rigid cap member 14. The body 16 of the blank member is formed of a cushioning material, with a closed cell foam material being eminently suitable for this purpose; one example of a suitable material is an EVA metallicine process foam elastomer material available under the trademark Engage™ foam from Dupont-Dow Elastomers, Wilmington, Del. An abrasion resistant fabric top layer may also be included, for enhanced durability and user comfort. The blank will generally extend the entire length of the underlying shoe sole, although it will be understood that in some embodiments the blank may not extend the full length of the foot, e.g., the forward end may be truncated somewhat.

Figure 6:
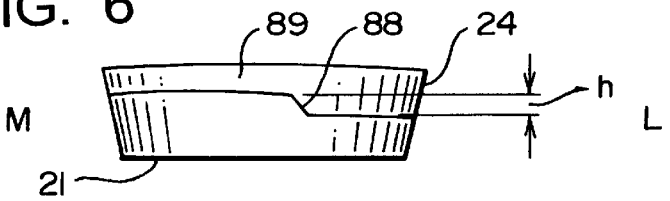
FIG. 6 is a rear, elevational view of the insole assembly of FIGS. 2–5, showing the transition of the stepped wall of the cap member from the medial side to the lateral side of the assembly.

The upper surface 18 of the cushioning blank is contoured to engage and cradle the plantar surface of a person's foot, and the bottom surface 21 is generally flat (e.g., see FIG. 4) so that this will match and rest on top of a standard shoe sole in a stable manner. A thin, substantially flat forefoot portion 20 extends generally in the transverse plane at the front of the blank, while the rearward end includes a downwardly concave heel cup portion 22. Also, as can be seen in FIG. 6, the perimeter surface 24 of the blank is relatively steeply angled at the rearfoot end, to match the inside of the upper where this joins the sole of the shoe, while the surface 26 of the heel cup is more shallowly curved; as a result, the wall 28 of foam material between these surfaces is relatively thick at its base and relatively thin and flexible at its upper edge.

Figure 4:
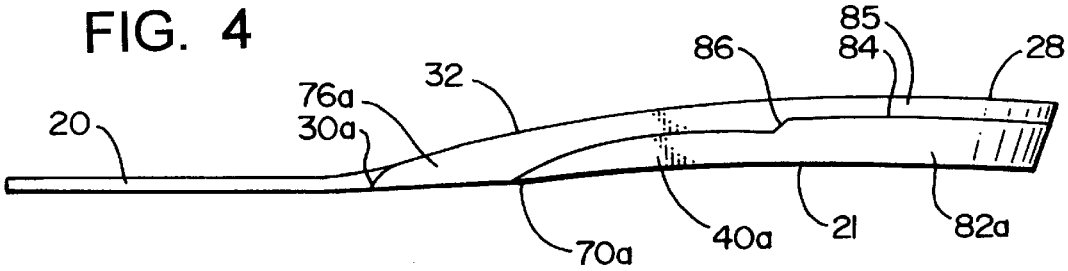
FIG. 4 is a left side elevational view of the insole assembly of FIG. 2, showing the stepped upper lip of the wall of the cap on the medial side of the rearfoot area.
Figure 5:
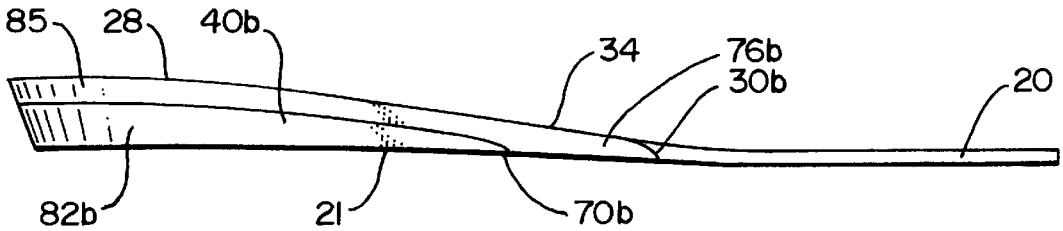
FIG. 5 is a right side elevational view of the insole assembly of FIGS. 2–4, showing the relationship of the wall of the cap member to the blank member on the lateral side of the rearfoot area.

Viewed in profile, as seen in FIGS. 4–5, the rearfoot wall 28 of the blank member is generally highest at its heel end, and tapers downward through the arch area until terminates at forward end points 30*a,* 30*b*. Furthermore, as can be seen by comparison of FIGS. 4 and 5, the rearfoot wall 28 is somewhat higher on the medial side through the midfoot area of the blank member, so that the cushioning material of the member is somewhat thicker and more upcurved in the areas 32 under the arch of the foot, and somewhat thinner in the corresponding area 34 on the lateral side of the device.

The rigid cap member, in turn, is configured to cooperate with the cushioning blank so as to maintain the shape of the insole without relying on inward buttressing from the shoe, and also to provide optimized support for different parts of the foot. As can be seen, the cap member is a comparatively thin, bifurcated, generally U-shaped component which extends around the rearfoot end of the blank member and forwardly along the sides thereof. The cap member is suitably formed of injection molded polyethylene, polypropylene, or of other plastic material which is relatively light in weight yet which possesses sufficient strength and rigidity, although it will be understood that other materials which are generally rigid but still somewhat flexible may be employed in various embodiments of the invention.

As can be seen in the figures, the cap member and the rearfoot portion of the blank member are sized and contoured to interfit with one another, so that the interior surfaces of the cap member match and bear against the corresponding surfaces on the exterior of the foam blank. The surfaces may be joined by any suitable means, including adhesive or thermal bonding, for example. Preferably, the outer surfaces of the cap member lie flush with the adjacent surfaces of the blank, i.e., there is a smooth joint without a pronounced step or ridge where the two meet. Depending on the materials which are employed, this interfit can be achieved by forming a recess in the bottom of the blank member which corresponds to the edge of the cap member, or by pressing the two members together in a mold under a predetermined heat and/or pressure which renders the foam material somewhat fluid so that this flows out flush with the edges of the cap.

The cap member itself includes medial and lateral upstanding walls 40*a,* 40*b* which extend along the sides of the blank member and around its rearfoot end 42. First and second flange portions 44*a,* 44*b* extend inwardly from the bottom edges of the wall portions, and are connected by a relatively narrow, horseshoe-shaped rearfoot flange 46 which extends around the heel end of the device so as to partially surround the heel cup portion of the blank.

The medial and lateral flange portions 44*a,* 44*b* are in turn subdivided into two sets of support flanges which engage the bottom surface of the blank member. The first set comprises a pair of relatively large, medial and lateral primary support flanges 56*a,* 56*b*. These have generally arcuate inner edges 58*a,* 58*b* which converge towards the longitudinal centerline of the assembly, but which remain separated by a central open area of the foam material. At their rearward ends 60*a,* 60*b,* the curved edges of the primary support flanges connect with the inner edge 62 of the rearfoot flange 46; at their forward ends 64*a,* 64*b* they diverge outwardly and join with the inner edges 66*a,* 66*b* of a set of smaller, secondary support flanges 68*a,* 68*b*.

The inner edges of the secondary support flanges are also arcuate in form, and taper forwardly to tips 70*a,* 70*b* which coincide with the forward ends of sidewalls 40*a,* 40*b,* and therefore represent the forward limits of the rigid cap member. The absence of any transverse connection between the forward ends of the cap member allows the two sides or "arms" 54 of the cap member to flex and spread apart in somewhat independently as the insole is compressed under the wearer's foot; this in turn enables the assembly to expand outwardly to match the width of the shoe, and also allows the requisite strength and rigidity to be achieved without compromising the device's capacity for cushioning the foot.

As can also be seen in the figures, the generally horizontal flanges meet the walls of the cap member along a substantially continuous corner line 72. This line is carried forwardly of the cap member by corner lines 74*a,* 74*b* which are formed between the bottom surface 78 and wall 28 of the foam blank member, and which flair outwardly to the medial and lateral edges of the forefoot extension 20. The resulting continuous corner line all about the bottom of the assembly corresponds to the corner between the sole and upper on the inside of the shoe, thereby preventing unwanted movement of the device and maximizing use of available volume within the shoe.

b. Zones of Support

Figure 2:
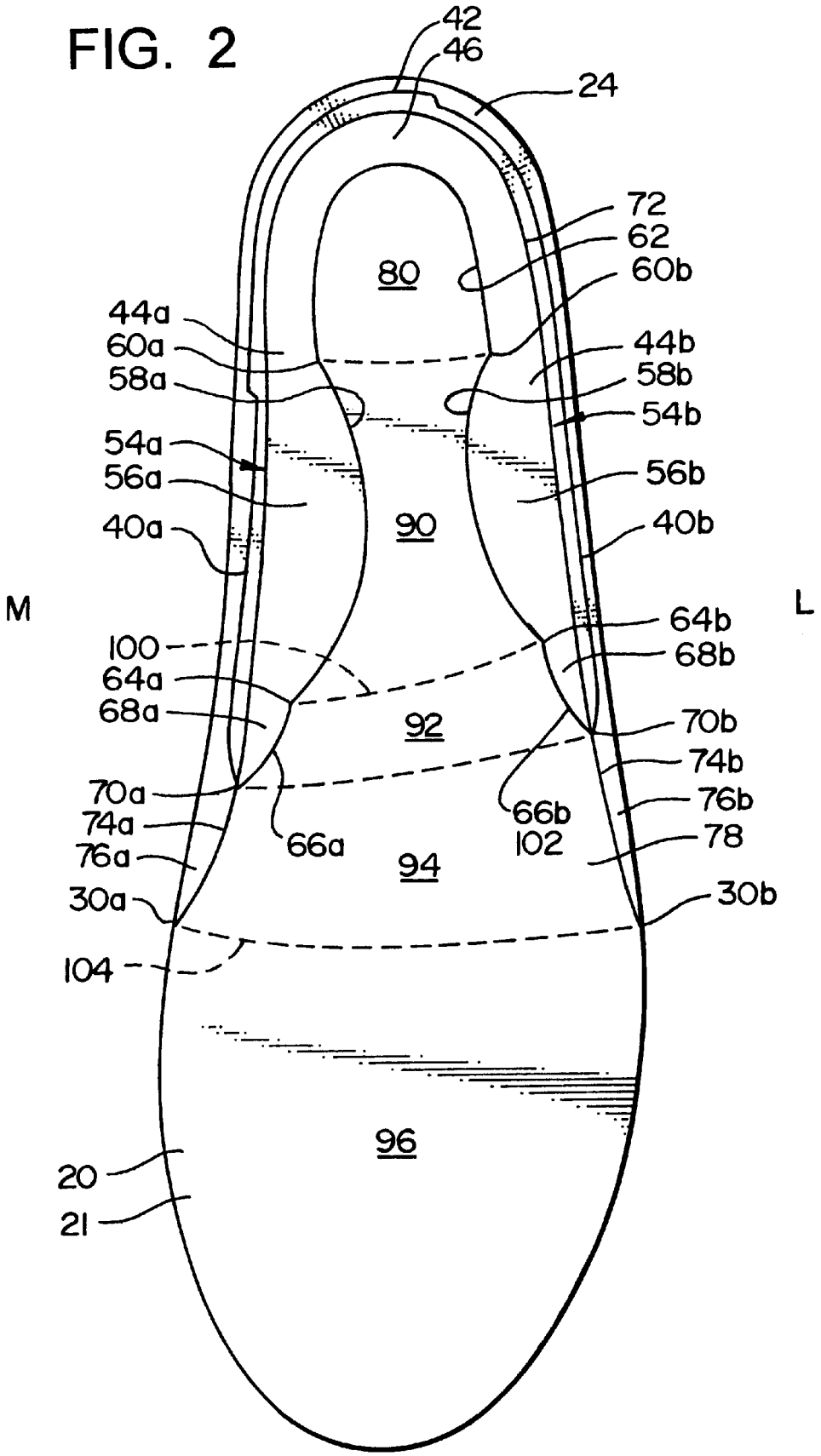
FIG. 2 is a bottom, plan view of the assembled insole of FIG. 1, showing the shape of the cap member and the manner in which this engages and supports the rearfoot and midfoot portions of the blank member.
Figure 3:
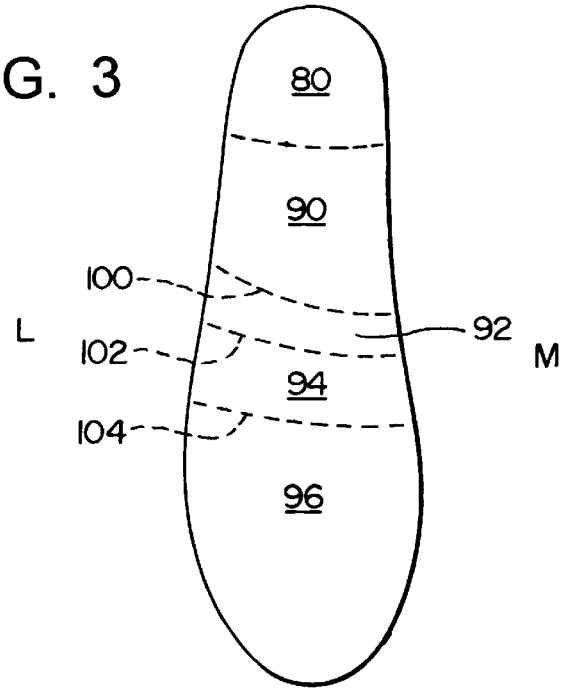
FIG. 3 is a top, plan view of the insole assembly of FIG. 2, showing the sequential zones of support which are formed by cooperation of the blank and cap members of the assembly.

As is shown in FIG. 2, the cap and blank members cooperate to define a series of regions or zones in which the support provided by the device is tailored to meet the changing biomechanical requirements of a wearer's foot as it progresses through the gait cycle.

By way of background, it will be understood that the structure and stability of the foot change as the foot moves through the gait cycle, and that this in turn dictates the nature of the support which is required for each area of the foot. At heel strike, when the person's weight first comes down on the heel of the foot, the bones are positioned in a comparatively loose and unstable configuration, referred to as a "mobile adaptor" configuration, in preparation for moving into contact with the ground or other underlying surface. Then, as the weight begins to shift forwardly on the foot, the internal structure becomes progressively more stable and ultimately transitions to a substantially rigid, locked configuration, referred to as a "rigid lever" configuration, for effective propulsion at toe-off. Consequently, it will be understood that (for a normal foot) support is most needed in the rearfoot area and forwardly through the midtarsal joint, so as to stabilize and control the motions of the foot through the early phases of the gait cycle when its internal structure is comparatively loose and unstable.

Accordingly, as can be seen in FIG. 2, the rearward ends of the cap and blank members of the present invention cooperate to form a first support zone 80 in the heel area of the device, which controls and supports the foot when it is in its least stable configuration. In this area, the cap member has relatively high rearfoot wall portions 82*a,* 82*b* along the medial and lateral sides which provide inward support around the perimeter of the blank so as to limit outward deformation of the foam material which forms the heel cup, thereby assisting in holding and stabilizing the heel in its proper orientation.

Also, as can best be seen in FIGS. 4 and 6, the medial wall portion of the cap preferably has a stepped, upwardly projecting lip 84 formed along its upper edge. The lip extends from a first end 86 near the forward end of the heel cup, to a second end 88 near or just slightly past the heel end of the blank. The additional height "h" of the lip provides increased support along the medial side of the heel cup, where this is most needed in order to stabilize the heel of the foot during and immediately following heel strike, while still maintaining flexibility around the rest of the rim of the heel cup and minimizing added weight. Moreover, as can be seen in FIG. 2, the cap walls terminate a short distance below the rim 85 of the foam blank all around the heel end of the device, so as to ensure that the upper edge of the insole remains soft and flexible for enhanced user comfort.

At the bottom of support zone 80, in turn, the rearfoot flange 46 is relatively narrow and defines a comparatively broad open area of foam material towards the center of the heel area, so as to maximize the depth of foam material which is available directly beneath the heel (i.e., the calcaneus) for shock absorption at heel impact.

Forwardly of zone 80, support flanges 56*a,* 56*b* converge towards the centerline of the device so as to define a second support zone 90, which corresponds generally to the proximal-midfoot area of the wearer's foot. The foam member is strongly contoured in this area to cradle and direct the motion of the foot, and is also somewhat thickened so as to form an upward incline at the forward end of the heel cup. The flanges 56*a,* 56*b,* in turn, serve to provide additional rigidity and support in the area beneath the rearward end of the arch and midfoot, and also help to maintain the shape of the foam member under the pressure of repeated, comparatively high loads which are generated as the person's weight shifts forwardly out of the heel cup.

Near the middle of zone 90 the arcuate inner edges of the flanges converge to define a comparatively narrow, waisted-down area, and then diverge so as to form an increasingly wide gap across the bottom of the foam blank. As a result, the flanges provide graduated support throughout the arch and midfoot portions of the blank, with maximum control being provided generally in the area just proximal the midtarsal joint, and with progressively less rigidity being provided as the person's weight shifts forwardly onto the broader areas of the foot. The greatest rigidity/control is thus provided when the foot is comparatively loose and unstable, followed by increased flexibility/cushioning as the foot transitions to its more rigid, stable configuration. Moreover, the arcuate shape of the flanges, as opposed to an angular configuration, provides a smooth, progressive transition in stiffness, without any abrupt or unnatural changes in support/rigidity.

Forwardly of the primary flanges 56*a,* 56*b,* the projecting secondary flanges 68*a,* 68*b* define a third support zone 92 which provides strength/rigidity in the distal-midfoot area, over which the person's weight passes as it moves towards the ball of the foot. The smaller, more widely spaced flanges 68*a,* 68*b,* while still providing a degree of rigidity and control in this area, enable this part of the assembly to flex and compress somewhat more easily than the more rearward zones, since the foot has transitioned to a more stable configuration at the corresponding point in the gait cycle. Also, as with the primary support flanges, the curved inner edges of the secondary flanges 68*a,* 68*b* flare outwardly so as to progressively increase the span of foam material between them, thereby increasing the softness and flexibility of the insole in the forward direction.

The raised, thickened arch portion of the foam blank extends beyond the forward tips 70*a,* 70*b* of the cap member, until it reaches the generally planar forefoot extension 20 at points 30*a,* 30*b,* thereby defining a fourth support zone 94 which lies generally proximal the metatarsal head area of the wearer's foot. At the corresponding point in the gait cycle, the person's weight is moving onto the broad plantar surface under the ball of the foot, and the bone structure of the foot has transitioned largely to the stable, "rigid lever" configuration described above. Consequently, while the contour of the foam blank still provides an element of control in this area, the principal function of this portion of the insole is to cushion the foot, and the absence of any part of the rigid cap in this area enables the blank to do this by flexing and compressing somewhat more freely.

The forefoot extension 20 of the blank member forms the final support zone 96. The forefoot extension comprises a relatively thin, flat layer of foam material, which absorbs less energy at toe-off than would a thick cushioning layer and therefore permits more efficient propulsion. Moreover, the fact that the rigid cap terminates well rearwardly of this area allows the forefoot extension to flex freely in concert with the phalanges and sole of the shoe during the final phases of the gait cycle.

It will also be observed, particularly in FIG. 2, that the forward end points of the flanges/side walls of the device are positioned somewhat more forwardly on the medial side (see 64*a,* 70*a,* and 30*a*) than on the lateral (see 64*b,* 70*b,* and 30*b*). Corresponding end points on opposite sides of the device thus define borders between the cushioning zones which extend at generally rearward angles rather than straight across the insole, as indicated by dotted lines 100, 102, and 104 (see also FIG. 3). These angles correspond generally to the angle defined by the metatarsal heads of the wearer's foot, in which the metatarsal head of the medial (first) ray of the foot is normally positioned somewhat more forwardly than that of the lateral (fifth) ray. The edges of the cushioning zones are thus angled to correspond generally to the manner in which weight is borne in the transverse direction across the foot, as well as in the longitudinal direction, particularly in the midfoot area.

In summary, the foam blank and rigid cap member cooperate to define a series of distinct support zones 80, 90, 92, 94, and 96, each of which provides a form or degree of support which is matched to the biomechanical needs of the foot at the corresponding point in the gait cycle.

c. Example Dimensions

It will be understood that the actual dimensions of an insole assembly in accordance with the present invention will vary depending on the size of foot, the intended use of the shoe, and other factors, e.g., the widths of the various flanges may be somewhat greater or smaller than shown depending on the anticipated use of the device. For purposes of illustration, however, the approximate dimensions of one example are given in the following Table A with reference to the corresponding numerals in the figures, this example being formed of a medium density closed cell EVA foam blank and a 1.5 mm thick molded polyethylene cap.

TABLE A

| | |
|---|---|
| Overall Length | 10½" |
| Length to 60a | 2" |
| Length to 60b | 1⅞" |
| Length to 64a | 4¾" |
| Length to 64b | 4¼" |
| Length to 70a | 5½" |
| Length to 70b | 5¼" |
| Lenqth to 30a | 6¾" |
| Length to 30b | 6½" |
| Width Flange 46 | ⅜" |
| Max width Flange 56a | ¾" |
| Max width Flange 56b | 11/16" |
| Min width between Flanges 56a–56b | ¾" |
| Max width Flange 68a | 5/16" |
| Max width Flange 68b | ¼" |
| Width between 60a–60b | 1¼" |
| Width between 64a–64b | 2" |
| Width between 70a–70b | 2¾" |
| Width between 30a–30b | 3⅝" |
| Height Rearfoot Wall 78 | ¾" |
| Height Rearfoot Cap Walls 82 | ¾" |
| Height Cap Lip 84 | ½" |
| Foam Thickness Center Heel Cup 22 | ⅛" |
| Foam Thickness Arch Area 32 | ¼" |
| Foam Thickness Forefoot Extension 20 | ⅛" |

Again, it will be understood that the above dimensions are provided for purposes of illustration only, although the relative proportions between the features will, for most embodiments, be generally consistent within a fairly nominal range.

It is to be recognized that various alterations, modifications, and/or additions may be introduced into the constructions and arrangements of parts described above without departing from the spirit or ambit of the present invention as defined by the appended claims.

What is claimed is:

1. An article of footwear having an insole assembly, said insole assembly comprising:

A substantially soft, resiliently compressible cushioning blank member having an upper surface for engaging a plantar surface of a foot and a bottom surface for engaging a sole of said article of footwear; and a U-shaped, substantially rigid, resiliently flexible cap member having a rearfoot portion which extends around a heel end of said blank member and medial and lateral side portions which extend forwardly from said rearfoot portion on opposite sides of a central opening in said cap member, said cap member having a relatively thin, substantially uniform thickness and comprising:

a support wall which extends generally upwardly in engagement with an outer edge of said cushioning blank member; and first and second support flanges which extend inwardly along said medial and lateral side portions of said cap member in engagement with said bottom surface of said blank member so as to provide relatively greater rigidity and support beneath selected medial and lateral areas of a wearer's foot;

said first and second flanges being separated by said central opening in said cap member, so that a central portion of said bottom surface of said blank member is unsupported by said rigid cap member so as to provide relatively greater cushioning beneath a selected central area of a wearer's foot.

2. The article of footwear of claim 1, wherein said cushioning blank member comprises:

a downwardly concave heel cup portion for engaging a heel of a wearer's foot; and an upwardly arched midfoot portion for engaging an arch portion of a wearer's foot.

3. The article of footwear of claim 2, wherein said first and second flanges each comprise:

first and second primary flange portions which extend inwardly across said bottom surface of said blank member under said arches midfoot portion thereof.

4. The article of footwear of claim 3, wherein said edges of said first and second primary flange portions each follow a generally arcuate path between rearward and forward end points located proximate said wall portion of said cap member.

5. The article of footwear of claim 4, wherein said rearward end points of said edges of said first and second primary flange portions are positioned longitudinally proximate a forward end of said heel cup portion of said cushioning blank member.

6. The article of footwear of claim 5, wherein said cap member further comprises:

a horseshoe shaped rearfoot flange portion which extends around said rearfoot end of said blank member from said rearward end point of said medial flange portion to said rearward end point of said lateral flange portion.

7. The article of footwear of claim 6, wherein said rearfoot flange portion of said cap member comprises:

an inner edge of said rearfoot flange portion which extends generally parallel to said outer surface of said cushioning blank member around said rearfoot end of said blank member.

8. The article of footwear of claim 4, wherein said forward end point of said edge of said flange portion on said medial side of said blank member is located longitudinally forward of said forward end point of said flange portion on said lateral side of said blank member, so that said forward end points of said flange portions define a forward border of an area of support between said primary flange portions, which extends at a predetermined rearward angle from said medial to said lateral side of said blank member.

9. The article of footwear of claim 8, wherein said predetermined angle at which said forward border of said area of support extends is generally parallel to an angle at which the metatarsal heads of a wearer's foot extend, from a medial to a lateral side thereof.

10. The article of footwear of claim 4, wherein said at least one flange portion of said cap member further comprises:

first and second secondary flange portions extending inwardly across said bottom surface of said blank member under said midfoot portion thereof, forwardly of said primary flange portions.

11. The article of footwear of claim 10, wherein said first and second secondary flange portions have inner edges which are spaced apart from one another by an open area of said bottom surface of said blank member which is wider than an open area by which said inner edges of said primary flange portions are spaced apart.

12. The article of footwear of claim 11, wherein said inner edges of said secondary flange portions follow generally arcuate paths between rearward and forward end points which are located proximate said wall portion of said cap member.

13. The article of footwear of claim 12, wherein said rearward end points of said edges of said secondary flange portions coincide with said forward end points of said first and second primary flange portions.

14. The article of footwear of claim 13, wherein said forward end points of said secondary flange portions coincide with forward end points of said wall portion of said cap member along medial and lateral sides of said blank member.

15. The article of footwear of claim 14, wherein said cushioning blank member further comprises:

a substantially flat, thin forefoot extension portion for engaging a forefoot portion of a wearer's foot, forwardly of said midfoot portion of said blank member.

16. The article of footwear of claim 15, wherein said cushioning blank member further comprises:

first and second generally vertically extending wall portions of said outer surface of said blank member which extend along medial and lateral sides of said blank member, and which taper forwardly of said secondary flange portions to forward end points proximate said medial and lateral sides of said blank member at a rearward end of said forefoot extension thereof.

17. The article of footwear of claim 16, wherein said forward end point of said medial wall portion of said blank member is located forwardly of said forward end point of said lateral wall portion of said blank member, so that said forward end points of said medial and lateral wall portions of said blank member define a forward border of an area of support between said wall portions which extends at a predetermined rearward angle from said medial to said lateral side of said blank member.

18. An article of footwear having an insole assembly, said insole assembly comprising:

a cushioning blank member formed of a soft, resiliently yieldable material, said blank member having an upper surface for engaging a plantar surface of a wearer's foot and a bottom surface for engaging a sole of said article of footwear; and a U-shaped cap member formed of a rigid, resiliently flexible material and having medial and lateral side portions and a central opening, said cap member having a relatively thin, uniform thickness and comprising:

a support wall which extends generally upwardly in engagement with an outer edge of said cushioning blank member; and at least one support flange which extends generally horizontally from one of said side portions of said cap member in engagement with said bottom surface of said blank member so as to provide additional rigidity and support beneath a selected area of a wearer's foot;

said medial and lateral side portions of said cap member being separated by said central opening and being joined only by a central portion of said cushioning blank member, so that said soft, resiliently yieldable material of said blank member allows said medial and lateral side portions of said cap member to spread and flex independently under a wearer's foot.

19. The article of footwear of claim 18, wherein said at least one support flange comprises:

first and second support flanges which extend inwardly along said medial and lateral side portions of said cap member for providing additional rigidity and support beneath medial and lateral sides of a wearer's foot.

20. The article of footwear of claim 19, wherein each of said first and second support flanges comprises:

convexly-curved primary flange portions which extend inwardly along said medial and lateral side portions of said cap member and converge towards said central portion of said blank member, so that said converging flange portions cooperate with said resiliently yieldable material of said blank member to provide progressively increasing and then decreasing rigidity and support beneath a central portion of a wearer's foot.

21. The article of footwear of claim 20, wherein said first and second support flanges further comprise:

convexly-curved secondary flange portions which extend inwardly along said medial and lateral side portions of said cap member forwardly of said primary flange portions and which diverge outwardly towards forward ends of said medial and lateral portions, so that said diverging secondary flange portions cooperate with said resiliently yieldable material of said blank member to provide progressively increasing flexibility towards a forward end of said insole assembly.

22. The article of footwear of claim 20, wherein said support wall extends continuously around a rearward end of said cushioning blank member and forwardly along medial and lateral sides thereof.

23. The article of footwear of claim 22, wherein said support wall comprises:

a stepped, upwardly projecting lip which extends along a rearward and medial side portion of said cap member for providing increased support for a heel cup of said cushioning blank member.

24. The article of footwear of claim 22, wherein said cap member further comprises:

a narrow, horseshow-shaped support flange which extends inwardly from said support wall around a heel end of said cushioning blank member.

25. The article of footwear of claim 22, wherein said support wall and flanges are generally planar members which are joined together as a unitary structure which forms said cap member.

26. The article of footwear of claim 25, wherein said unitary structure which forms said cap member is a molded plastic structure.

27. An article of footwear having an insole assembly, said insole assembly comprising:

a cushioning blank member formed of a soft, resiliently yieldable material, said blank member having an upper surface for engaging a plantar surface of a wearer's foot and a bottom surface for engaging a sole of said article of footwear; and a U-shaped cap member formed of a rigid, resiliently flexible material, said cap member being configured to cooperate with said cushioning blank member so as to provide zones of differential support beneath a wearer's foot, said cap member having a thin, substantially uniform thickness and comprising:

a support wall which extends generally upwardly in engagement with an outer edge of said cushioning blank member;

a horseshoe-shaped support flange which extends generally horizontally in engagement with said bottom surface of said cushioning blank member along a rearward border of an opening in said cap member beneath a heel cup of said blank member, so that said horseshoe-shaped flange cooperates with said soft, resiliently yieldable material of said blank member to provide a first support zone of increased cushioning beneath a heel area of a wearer's foot;

first and second primary support flanges which extend inwardly along medial and lateral sides of said cap member in engagement with said lower surface of said cushioning blank member, said primary support flanges converging towards a central opening beneath an arch and midfoot area of said cushioning blank member, so that said converging flanges cooperate with said soft, resiliently yieldable material of said blank member to provide a second support zone in which rigidity progressively increases and then decreases in a forward direction beneath an arch and midfoot area of a wearer's foot; and first and second secondary support flanges which extend inwardly along medial and lateral sides of said cap member in engagement with said bottom surface of said blank member, said secondary flanges being positioned forwardly of said primary support flanges and diverging outwardly from said central opening towards a forward end of said assembly, so that said diverging support flanges cooperate with said soft, resiliently yieldable material of said blank member to provide a third support zone in which rigidity progressively decreases and cushioning progressively increases in a forward direction beneath a distal-midfoot area of a wearer's foot.

28. The article of footwear of claim 27, wherein said primary support flanges have substantially arcuate, converging inner edges so as to provide a smoothly progressive increase and decrease in rigidity beneath said arch area of a wearer's foot.

29. The article of footwear of claim 28, wherein said cushioning blank member comprises:

a thickened arch portion which tapers forwardly of said secondary support flanges, so that said soft, resiliently yieldable material in said thickened portion provides a fourth support zone in which cushioning progressively decreases in a forward direction beneath a metatarsal head area of a wearer's foot.

30. The article of footwear of claim 29, wherein said cushioning blank member further comprises:

a thin, substantially flat forefoot extension portion which extends forwardly of said thickened arch portion so as to extend beneath a toe area of a person's foot.

31. The article of footwear of claim 28, in which said support wall and flanges are thin, generally planar members which are joined together as a unitary structure which forms said cap member.

32. The article of footwear of claim 31, wherein said unitary structure which forms said cap member is a molded plastic structure.

33. The article of footwear of claim 32, wherein said cushioning blank member is a unitary resilient foam structure.

* * * * *